United States Patent [19]

Blume et al.

[11] Patent Number: 4,926,296

[45] Date of Patent: May 15, 1990

[54] ILLUMINATED CARRYING BAG

[76] Inventors: Linda A. Blume, Apartment 105, 2504 Gulf Blvd., Indiana Rocks Beach, Fla. 34635; Kathy Y. Henn, 13520 Rustic Pines Blvd. S., Seminole, Fla. 34646; John D. Osher, 3275 Warrensville Center Rd., Apartment 101, Shaker Heights, Ohio 44122

[21] Appl. No.: 438,591

[22] Filed: Nov. 17, 1989

[51] Int. Cl.[5] ..... F21V 33/00

[52] U.S. Cl. ..... 362/156; 362/802

[58] Field of Search ..... 362/155, 156, 802, 806

[56] References Cited

U.S. PATENT DOCUMENTS

| | | | |
|---|---|---|---|
| D. 169,265 | 4/1953 | Lavezzorio . | |
| D. 254,478 | 3/1980 | Carroll . | |
| D. 258,205 | 2/1981 | Kroll . | |
| D. 258,423 | 3/1981 | Alvarez et al. . | |
| D. 261,861 | 11/1981 | Carter . | |
| 740,817 | 10/1903 | Davis . | |
| 804,168 | 11/1905 | Olin . | |
| 1,458,687 | 6/1922 | Dessart . | |
| 1,577,517 | 3/1923 | Chandler . | |
| 1,814,685 | 7/1931 | Glass . | |
| 2,218,396 | 10/1940 | Hallbauer | 362/156 |
| 3,045,900 | 7/1962 | Zekendorf | 362/156 X |
| 3,312,337 | 4/1967 | Martin . | |
| 4,091,443 | 5/1978 | Ohrenstein et al. | 362/156 |
| 4,638,412 | 1/1987 | Weigert | 362/156 |
| 4,698,732 | 10/1987 | Hickey . | |
| 4,714,985 | 10/1987 | Hickey . | |
| 4,802,071 | 1/1989 | Schuster . | |

*Primary Examiner*—Allen M. Ostrager

*Attorney, Agent, or Firm*—Wood, Herron & Evans

[57] ABSTRACT

An illuminated flexible bag is provided for transporting articles by an individual. The bag is formed by joining a front and back sidewall at their edges with a bottom wall. At the top edge of the front sidewall of the bag a fastener is used to attach a handle, a protective flap and a pouch to the front sidewall. The pouch contains a power source which energizes light bulbs which are mounted adjacently to transparent portions of the front sidewall. The light from the light bulbs shines through the transparent portion of the front sidewall for safety and decorative purposes. The protective flap protects the light bulbs from the contents of the bag. The bag is especially designed for festive occasions which are celebrated in the evening or at times of the year when there are few daylight hours such as Halloween or Christmas.

11 Claims, 1 Drawing Sheet

ILLUMINATED CARRYING BAG

BACKGROUND OF THE INVENTION

This invention relates to bags used by individuals for carrying articles. More specifically, the invention relates to decorative bags used at festive occasions when lighting conditions are poor such as Halloween, although other similar occasions are envisioned.

Decorative bags have been used at holiday times to carry articles from one location to another. Some of these holidays primarily utilize the evening hours for celebration such as Halloween, while others are celebrated at a time of the year when there are few daylight hours such as Christmas. To aid in the location of individuals using such bags on these occasions, different methods using light to indicate the bag position have been used. One such method uses reflective material in the bag construction or on the individual. This material appears to shine when light from an illumination source reflects upon the material. One limitation of this method is the requirement of a light source which is external to the bag and the individual who is carrying the bag.

A second method for providing a position indicator within a carrier of articles has been described in U.S. Pat. No. 4,802,071. This patent discloses a holiday lantern which contains a power source and can be used to transport articles. This lantern requires a light source assembly and an outer shell assembly. The light source assembly requires a complex mechanism which includes a switch and an integral light bulb. Additionally, the lantern opening is only maintained in the open position and the lower edge of the opening can be no higher than the level of the lamp in the light source assembly. Such lanterns are also difficult to carry since they are not flexible and cannot conform to various shapes for easy transportation.

SUMMARY OF THE INVENTION

It is an object of the present invention to indicate the position of the bag without using an external light source.

It is an object of the present invention to provide a bag having decorative and safety functions which can be simply constructed.

It is an object of the present invention to illuminate decorative designs on a bag exterior.

It is an object of the present invention to protect the light bulbs attached to the bag from the movement of articles placed within the bag or from protruding edges from such articles.

To obtain the objects of the invention a flexible bag is provided with transparent portions in the sidewalls of the flexible bag. Light bulbs are attached adjacent to the transparent portions of the sidewalls to provide light external to the bag and to illuminate decorative designs on the bag. A flap is provided within the bag to protect the light bulbs attached to the transparent portions of the sidewall from the articles placed within the bag.

The objects are further attained by the use of tape to attach the light bulbs adjacent to the sidewalls. Another simple feature of the bag's construction is the elimination of a light switch to operate the illumination function of the bag. Another structural feature of the invention is the provision of a pouch to hold the power source and the attachment of the pouch to the bag by the same fasteners used for connecting a handle to the bag.

One advantage of this invention is a bag which is visible in a dim area. Another advantage is the enhancement of a decorative design on the outside of the bag by the light produced by the light bulbs. The low cost and ease of manufacture of the bag are additional advantages of the invention.

These and other objects and advantages of the present invention shall be made apparent from the accompanying drawings and the description thereof wherein:

BRIEF DESCRIPTION OF THE DRAWINGS

The accompanying drawings, which are incorporated and constitute a part of this specification, illustrate a preferred embodiment of the invention and, together with the general description given above, and the detailed description of the embodiment given below, serve to explain the principles of the invention.

DETAILED DESCRIPTION OF THE PREFERRED EMBODIMENT

Figure 1:
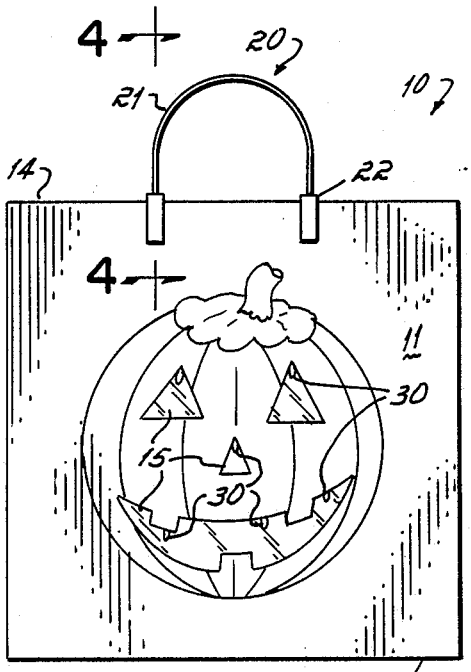
FIG. 1 is a front elevational view of the bag in the preferred embodiment.
Figure 2:
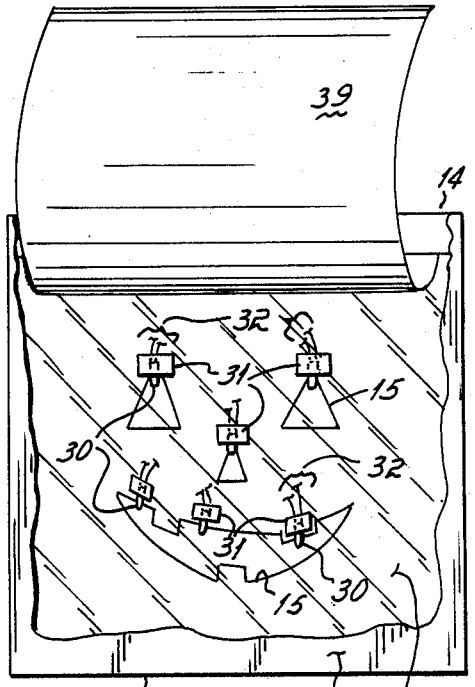
FIG. 2 is an elevational view of the interior of the sidewall of the bag with the protective flap raised to reveal the wiring of the light bulbs.

In FIGS. 1 and 2, a flexible plastic bag 10 such as that used in the present invention is depicted. The bag has a front wall 11, a back wall 12, a bottom wall 13 and a top edge 14. The front wall 11, the back wall 12 and the bottom wall 13 are joined together at their edges to form a bag 10 open at a top defined by top edge 14. Transparent portions 15 within the front wall 11 and the back wall 12 permit one to see through the front wall 11 and back wall 12. The bag is preferably constructed of a plastic sheet material such as polyurethane. In the illustrated form of the invention the outside of the front wall is printed to depict a jack-o-lantern. The jack-o-lantern has eyes, nose and mouth created by the transparent portions 15.

Figure 4:
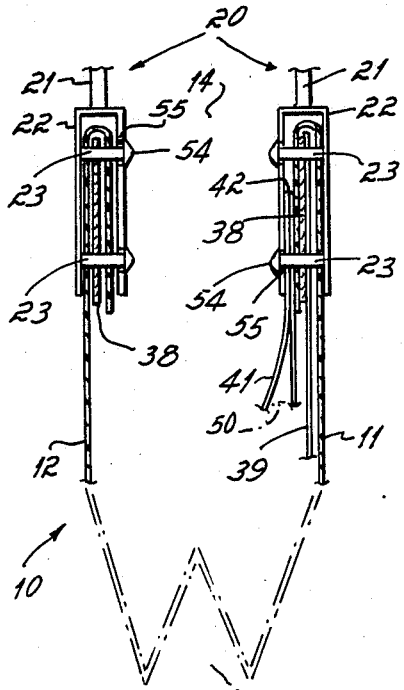
FIG. 4 is a diagrammatic cross-sectional view taken along lines 4—4 of FIG. 1.

Handles 20 are attached to the front and rear walls 11 and 12 as best seen in FIGS. 1 and 4. Each handle is comprised of an inverted U-shaped strap 21 which has a U-shaped fastener 22 attached to each end. Perforating members 23 are attached to one arm of the U-shaped fastener 22. These perforating members are then pushed through the front or rear wall of the bag and secured in the opposite arm of the U-shaped fastener 22. Thus, a handle 20 is secured to the wall 11 by two U-shaped fasteners 22 and similarly, a handle 20 is attached to the rear wall 12. The handles 20 attached to the front wall and back wall are congruent to one another when the top edge 14 of the bag 10 is closed.

In FIG. 2, light bulbs 30 are attached to the inside surface of the front wall 11 adjacent to each transparent portion 15 by pieces of adhesive tape 31. Each light bulb has two wires 32 which extend from the light bulbs. One wire from each bulb is attached to another wire from another bulb to form a continuous circuit through the bulbs on the front wall 11. The circuit through the light bulbs has two ends 33 and 34 (shown in FIG. 3) which will be attached to the power supply as discussed below. The bag 10 has a protective flap 39 which is attached to the upper edge of the front wall 11 by the perforating member 23 extending from the U-shaped fastener 22 of the handle 20. This attachment of the flap to the front wall by the fastener 22 is also shown in FIG. 4. The protective flap 39 in FIG. 2 is raised by a free end to expose the light bulbs 30 and the wires 32.

Figure 3:
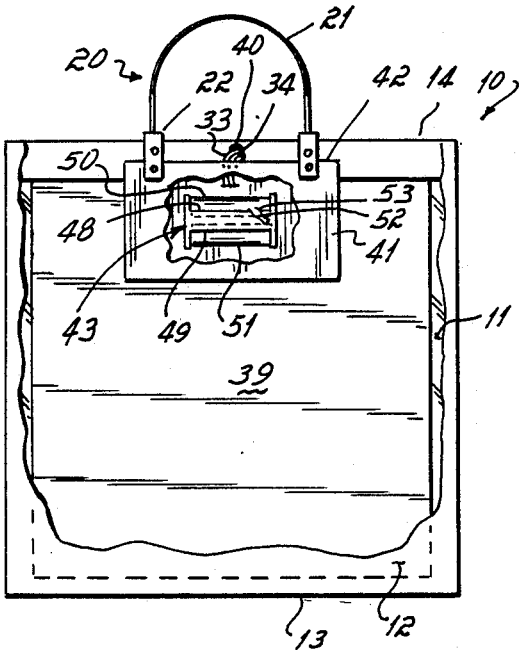
FIG. 3 is an elevational view of the sidewall of the bag with the protective flap lowered to protect the wiring of the light bulbs.

In FIG. 3, the protective flap 39 has been lowered so that the free end lies adjacent to the front wall 11. In this position the protective flap covers the light bulbs 30 and the wires 32. A hole 40 is located in an upper portion of the protective flap 39. A small pouch 41 with a top edge 42 is attached to the front wall 11 by the perforating members 23 of the U-shaped fasteners 22 much as the protective flap 39 was also attached to the front wall 11. This pouch 41 contains a battery holder 43. The battery holder 43 has two recesses 48 and 49 which contain batteries 50 and 51. Two wires 52 and 53 extend from the battery holder through the top edge 42 of the pouch into the hole 40 in the protective flap 39. These two wires 52 and 53 provide electrical connections to the cathode and anode ends of the batteries respectively. These wires 52 and 53 are connected to the ends of the bulb circuit 33 and 34 to provide power to the light bulbs 30.

FIG. 4 shows the cross-sectional construction of the flexible bag 10. The front wall 11, the protective flap 39 and the pouch 41 are placed adjacent to one another at their respective top edges. A stiffener 38 is placed between the pouch 41 and the flap 39. The head 54 of the perforating member 23 of the U-shaped fastener 22 is pushed through the front sidewall 11, the protective flap 39, the stiffener 38 and the pouch 41 into the hole 55 of the opposing arm of the U-shaped fastener 22. The fastener 22 now secures these elements along with the handle 20 to the front sidewall 11.

In operation, the batteries 50 and 51 are inserted into the battery holder 43. Once in place, these batteries provide electrical power for the light bulbs 30. This power is transferred by the wires leading from the battery holder 52 and 53 to the light bulb circuit ends 33 and 34. The energized light bulbs 30 will emit light through the transparent portions 15 of the front sidewall 11 and become visible to anyone in the vicinity of the bag. Within the overall design on the exterior of the front wall 11, these transparent portions 15 will also be emphasized. Whenever the top edge 14 of the bag 10 is opened and articles are placed in or removed from the bag, the light bulbs 30 and the wires 32 will be protected by the protective flap 39 from the edges of articles being placed in or removed from the bag.

Since the bag is constructed from light weight plastic the individual using the bag will be able to carry it without much exertion. The bag can withstand wrinkling during its use because the front sidewall, back sidewall and bottom wall are all flexible. To disable the illuminating function of the bag, one need only remove one end of one of the batteries from the battery holder recesses 48 or 49 to break the circuit powering the light bulbs. This preserves the life of the batteries for later operation. The manufacturing cost of the bag is minimized because no switch is employed.

While the present invention has been illustrated by the description of the preferred embodiment and while the embodiment has been described in considerable detail, it is not the intention of the applicant to restrict or any way limit the scope of the appended claims to such detail. Additional advantages and modifications will readily appear to those skilled in the art. The invention in its broader aspects is therefore not limited to the specific details, representative apparatus and illustrative example shown and described. Accordingly, departures may be made from such details without departing from the spirit or scope of applicant's general inventive concept.

What is claimed is:

1. A bag comprising:

a flexible front wall of plastic film having side, bottom and top edges;

a flexible back wall of plastic film having side, bottom and top edges;

said side and bottom edges of the respective walls being joined to form a receptacle opened at said top edges;

at least a portion of said flexible front wall being transparent;

at least one light bulb mounted on said flexible front wall overlying said transparent portion; and a power source connected to the light bulb.

2. A bag comprising:

a flexible front wall having side, bottom and top edges;

a flexible back wall having side, bottom and top edges;

said side and bottom edges of the respective walls being joined to form a receptacle opened at said top edges;

at least a portion of said flexible front wall being transparent;

at least one light bulb mounted on said flexible front wall overlying said transparent portion;

a power source connected to the light bulb;

at least one handle;

a fastener mounting said handle at said top edge of said flexible front wall; and a pouch for containing said power supply, said fastener also securing said pouch to said top edge.

3. A bag according to claim 2 wherein:

said transparent portions of said front flexible wall form a face, said face having at least a nose.

4. A bag according to claim 3 wherein:

said transparent portions form a pumpkin face.

5. A bag comprising:

a front flexible wall of thin sheet material having top, bottom and side edges, plural spaced portions of said front flexible wall being transparent with the remaining portion of said front flexible wall being opaque;

a back flexible wall of thin sheet material having top, bottom and side edges, said bottom and side edges of said front flexible wall being joined to said bottom and side edges of said back flexible wall to form said bag;

an inverted U-shaped handle fixed to the top of each wall to form handles for carrying the bag;

a light bulb attached to said front flexible wall adjacent each said transparent portion;

a battery connected to each said light bulb to energize said light bulb and cast light outside said bag.

6. A bag comprising:

a front flexible wall of thin sheet material having top, bottom and side edges, and a plurality of spaced transparent portions with the remaining portion of said front flexible wall being opaque to define a design;

a back flexible wall of thin sheet material having top, bottom and side edges, said bottom and side edges of said front flexible wall being joined to said bottom and side edges of said back flexible wall to form said bag:

a plurality of light bulbs attached to said front flexible wall, each bulb being adjacent each transparent portion; and a battery connected to said plurality of light bulbs to energize said plurality of light bulbs and cast light outside said bag.

7. A bag according to claim 6 further comprising:

a flexible sheet attached to said front flexible wall near said top edge of said front flexible wall, said flexible sheet substantially covering said front flexible wall and overlying said light bulbs to protect and insulate said light bulbs from any contents deposited in said bag.

8. A bag according to claim 7 further comprising:

an adhesive strip for mounting said light bulbs on said transparent portion of said flexible front wall.

9. A bag according to claim 8 wherein:

said power source is a continuous power source.

10. A bag according to claim 9 the bag further comprising:

a pouch mounted to said flexible front wall, the pouch containing said continuous power supply.

11. A bag according to claim 10 wherein:

said back flexible wall contains transparent portions; and said flexible sheet being transparent, said light bulbs illuminating said transparent portions in said flexible back wall.

* * * * *